US006311374B1

(12) United States Patent
Anscher

(10) Patent No.: US 6,311,374 B1
(45) Date of Patent: Nov. 6, 2001

(54) HIGH SECURITY BUCKLE ASSEMBLY

(76) Inventor: Joseph Anscher, 1928 Midlane, Muttontown, NY (US) 11791

( * ) Notice: Subject to any disclaimer, the term of this patent is extended or adjusted under 35 U.S.C. 154(b) by 0 days.

(21) Appl. No.: 09/517,656

(22) Filed: Mar. 3, 2000

(51) Int. Cl.[7] ..... A44B 11/26
(52) U.S. Cl. ..... 24/625
(58) Field of Search ..... 24/614, 615, 616, 24/625; D11/216, 218, 200, 606, 607

(56) References Cited

U.S. PATENT DOCUMENTS 4,825,515 * 5/1989 Wolterstorff, Jr. .
5,774,954 7/1998 French et al. .
5,991,985 11/1999 Galbreath .
6,138,330 * 10/2000 Galbreath .

FOREIGN PATENT DOCUMENTS 7-275012 * 10/1995 (JP) .
10-211005 * 8/1998 (JP) .
11-235208 * 8/1999 (JP) .

* cited by examiner

*Primary Examiner*—James R. Brittain
(74) *Attorney, Agent, or Firm*—Collard & Roe, P.C.

(57) ABSTRACT

A buckle assembly comprising a plug portion and a socket portion. The plug portion has a base, a pair of parallel side arms attached to and extending away from the base, the side arms being flexible toward each other, and a center arm disposed between the side arms and connected to the base as well. The center arm has a push button disposed adjacent the base and a catch disposed adjacent the push button. Both the catch and push button extend upward from the center arm. Each side of the socket portion has an aperture for receiving an end of one of the side arms, and the top surface of the socket portion has spaces to allow the push button and catch to protrude therethrough when the plug portion is inserted in the socket portion. The buckle assembly is locked by inserting the plug portion into the open end of the socket portion until the side arms protrude through the apertures and the push button and catch protrude through the spaces. The buckle assembly can only be disengaged by simultaneously pressing the center push button downward and the side arms inward until the catch clears the second space and the side arms clear the apertures in the socket portion.

9 Claims, 4 Drawing Sheets

HIGH SECURITY BUCKLE ASSEMBLY

BACKGROUND OF THE INVENTION

1. Field of the Invention

This invention relates to a high security buckle for many different uses. In particular, this invention relates to a plug and socket type buckle that requires two hands to release.

2. The Prior Art

Plug and socket type buckles have many different uses. For example, they are used as restraining belts for infants in high chairs, car seats and shopping carts, as well as for belt buckles for adult use. One type of plug and socket type buckle is a side release buckle, in which two sections of the plug extend through two side apertures on either side of the socket. Pressing the plug sections inward releases the plug from the socket. This maneuver can generally be accomplished with one hand. Another type of plug and socket buckle is a center push buckle. In a center push buckle, the socket has a button on its center top surface, either integral with the socket, or extending upward from the plug. Pushing the button releases the plug from the socket. In this case as well, the releasing operation can generally be accomplished with one hand.

There are situations, however, when it would be desirable to have a buckle that cannot be disengaged as easily. This is true especially with restraining devices for infants and toddlers, who may be able to figure out how to release the buckle by watching adults. Another situation would involve a belt buckle for a police or corrections officer, who might be engaged in physical contact with another person who could attempt to release the buckle.

For these reasons, there have been attempts to provide plug and socket type buckles that cannot be disengaged easily. U.S. Pat. No. 5,774,956 to French discloses a plug and socket type buckle that has both side-release latches and an additional center push button on the top of the socket portion. The center push button is part of the plug portion and extends through a hole in the socket. To release the buckle, both the side latches and the center button must be pressed in toward the interior of the socket at the same time. The center button must be pressed downward sufficiently so that it will clear the hole in the socket and allow the plug to slide out of the socket.

Another buckle of this type is shown in U.S. Pat. No. 5,991,985 to Galbreath. This buckle also has both side release latches and a center push button. In this patent, the center push button is part of the socket portion. Pressing the button causes a latch underneath the button to disengage from a corresponding latch on the plug portion and releases the plug from the socket when the side release latches are simultaneously pressed with the center button.

While these patents show buckles that are not as easily released as traditional side release or center push buckles, they still could be released with one hand, due to the location of the center button near the closed end of the socket. This location places the center push button very near the side release latches and allows a person to press the side release latches with the thumb and middle finger while simultaneously depressing the center button with the index finger.

In addition, the center latching mechanism on both of these patents cannot withstand large amounts of stresses, because the pull against the locking section is away from the pivot point on the release levers of each of the two patented buckles. This causes the center locking mechanism to release prematurely, i.e., before the button is fully depressed.

SUMMARY OF THE INVENTION

It is therefore an object of the present invention to provide a plug and socket type buckle that can only be released with two hands.

It is another object of the invention to provide a plug and socket type buckle having a center push button whose latching mechanism cannot be released before the button is fully depressed.

These and other objects of the invention are accomplished by a buckle assembly comprising a plug portion and a socket portion. The plug portion has a base, a pair of flexible parallel side arms attached to and extending away from the base, and a center arm disposed between the side arms and connected to the base as well. The center arm has a push button disposed adjacent the base and a catch disposed adjacent the push button. Both the catch and push button extend upward from the center arm.

The socket portion has a top surface, a bottom surface, two sides and an open end for receiving the plug portion. Each side has an aperture for receiving an end of one of the side arms, and the top surface has a first space and a second space therethrough to allow the push button and catch to protrude through the spaces, respectively, when the plug portion is inserted in the socket portion.

The buckle assembly is locked by inserting the plug portion into the open end of the socket portion until the side arms protrude through the apertures and the push button and catch protrude through the spaces. The buckle assembly can only be disengaged by simultaneously pressing the center push button downward and the side arms inward until the catch clears the second space and the side arms clear the apertures in the socket portion. This way, the buckle cannot be disengaged by a clever infant, or during a struggle with another person. Pressing the push button downward causes the catch to move downward as well, to clear the space on the socket portion and allow the buckle to be released.

The plug and socket portions each have a strap retaining bar thereon to attach the buckle assembly to one or more straps. The push button is disposed adjacent the open end of the socket portion when the plug portion is inserted in the socket portion. In a preferred embodiment, the first space comprises an indentation along an edge of the open end of the socket portion, so that the push button abuts the edge of the socket portion. This arrangement is preferable over the arrangement of the prior art buckles, because it places the push button as far back as possible from the side release arms. This way, the buckle cannot be disengaged by using the index finger to press the button downward while the thumb and middle fingers press the side arms inward.

To make the button operable, the center arm has a lever on which the push button and catch are disposed. The free end of the lever terminates adjacent the base and the push button is disposed at the free end of the lever. The lever has a fulcrum disposed approximately halfway between the base and the free end of the center arm to allow the lever to pivot when the push button is pressed.

The lever is preferably integrally formed with the center arm via a substantially U-shaped cutout in the center arm, with the bottom of the U adjacent the base. The fulcrum of the lever is then the top of the U and comprises a portion of the center arm that is thinner than the rest of the center arm, i.e., a living hinge, to allow the lever portion to flex against the center arm.

The catch preferably has a triangular cross-section so one side extends perpendicular to the top surface of the plug portion and another side slopes upward from the top surface of the plug portion. The perpendicular side faces the push button and the sloped side faces away from the push button. This way, the plug portion easily slides into the socket portion with the sloped side of the catch sliding into the space in the socket. The catch cannot then slide out of the space in the same way, because the perpendicular side of the catch abuts the side of the space and prevents any backward lateral movement of the plug in the socket.

Each side arm has a catching member disposed at its free end. Inserting the plug portion into the socket portion causes the catching members to protrude through the apertures and lock the plug portion into the socket portion. These catching members are preferably in the form of enlarged lobes at the end of the side arms, with a ledge at the end of the lobe nearest the base. This ledge catches on the aperture in the socket portion and also prevents backward lateral movement of the plug in the socket once the buckle is assembled.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
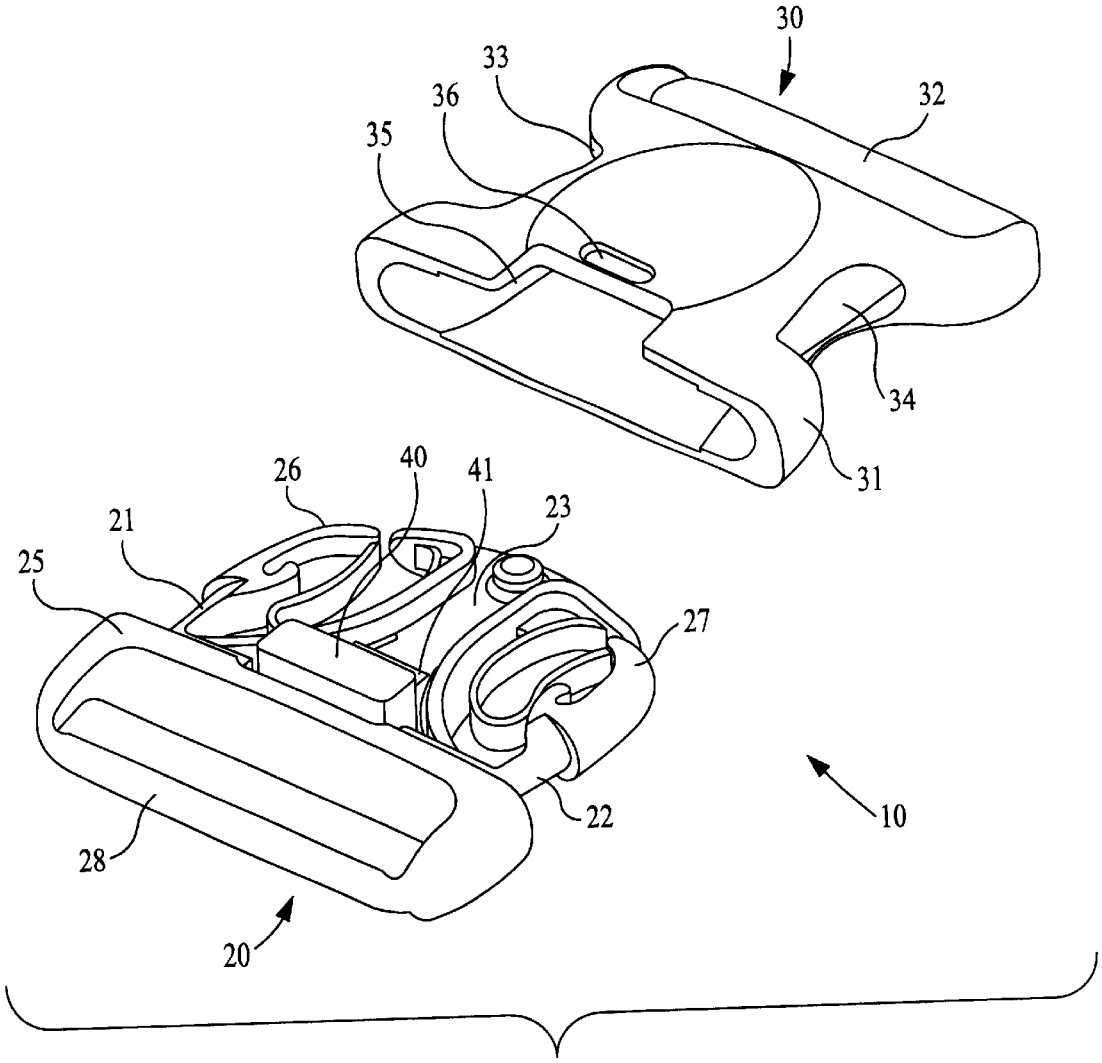
FIG. 1 shows a perspective view of the buckle assembly according to the invention.
Figure 2:
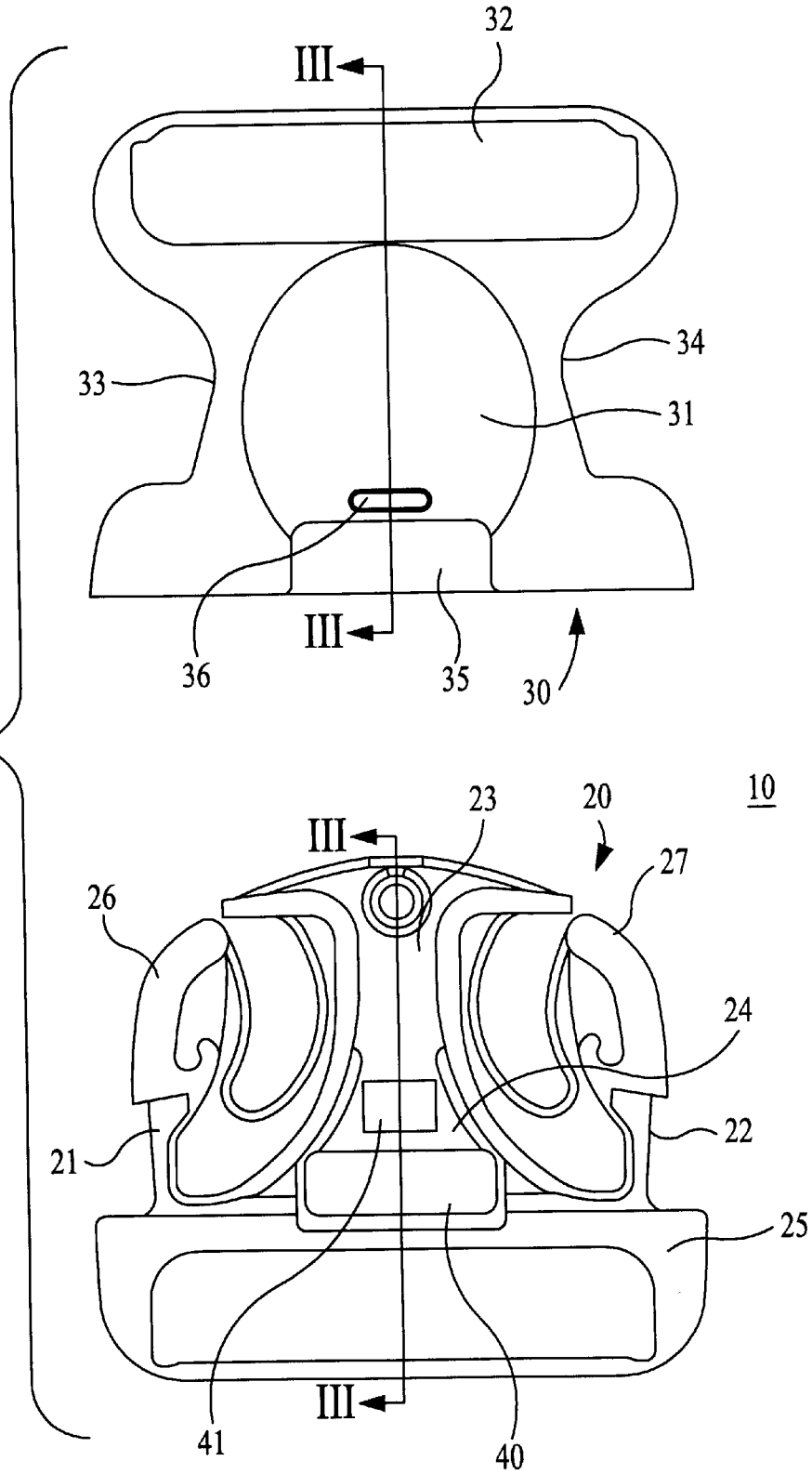
FIG. 2 shows a top view of the assembly shown in FIG. 1.
Figure 3:
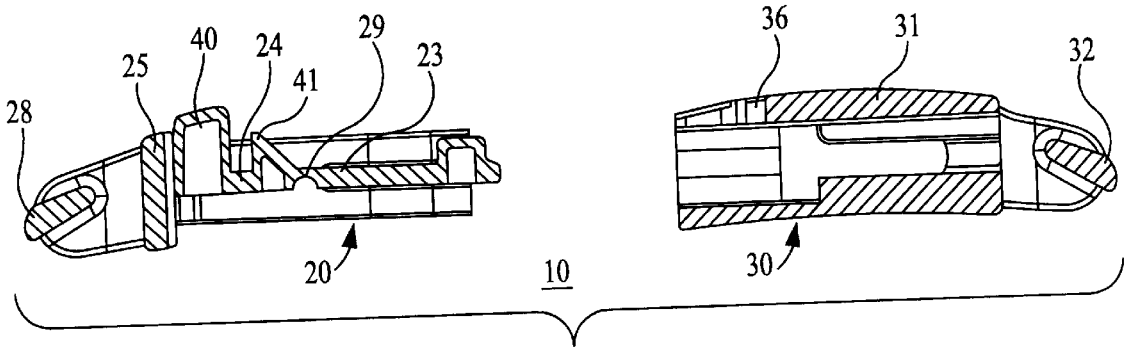
FIG. 3 shows a side cross-sectional view along lines III—III of FIG. 2.

Referring now in detail to the drawings, FIGS. 1–3 show the buckle assembly 10 according to the invention in a disassembled state. Buckle assembly 10 comprises a plug 20 and a socket 30. Plug 20 has side arms 21 and 22, and a central arm 23, all connected to a base 25. Side arms 21 and 22 have catching members 26 and 27, respectively, disposed at their free ends. A strap bar 28 is connected to base 25, to allow a strap (not shown) to be attached thereto.

Central arm 23 has an integral lever 24 cut into it so that the free end of lever 24 is adjacent base 25, as shown in FIG. 2. Lever 24 has a fulcrum 29 in the form of a living hinge, as shown in FIG. 3. Disposed at the free end of lever 24 is a push button 40 and a catch 41. Push button 40 is located at the tip of lever 24, with catch 41 located adjacent thereto.

Socket 30 comprises a hollow body 31 with a strap bar 32 at one end. Hollow body 31 has two apertures 33 and 34, for receiving arms 21 and 22, respectively, of plug 20. There is a cutout 35 for receiving push button 40, and an opening 36, for receiving catch 41, in the top of hollow body 31.

Figure 4:
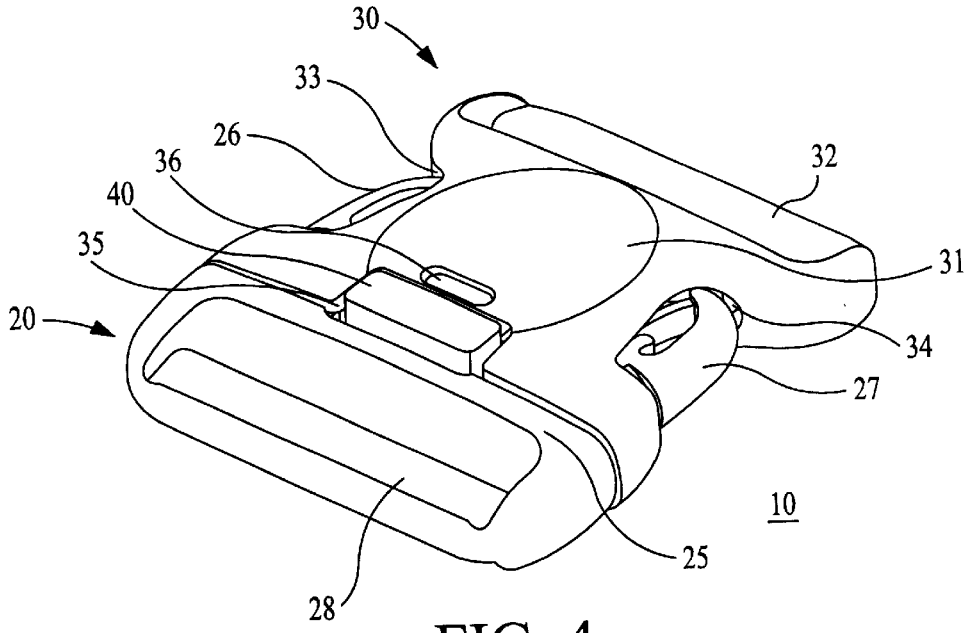
FIG. 4 shows a perspective view of the buckle assembly according to the invention as assembled.
Figure 5:
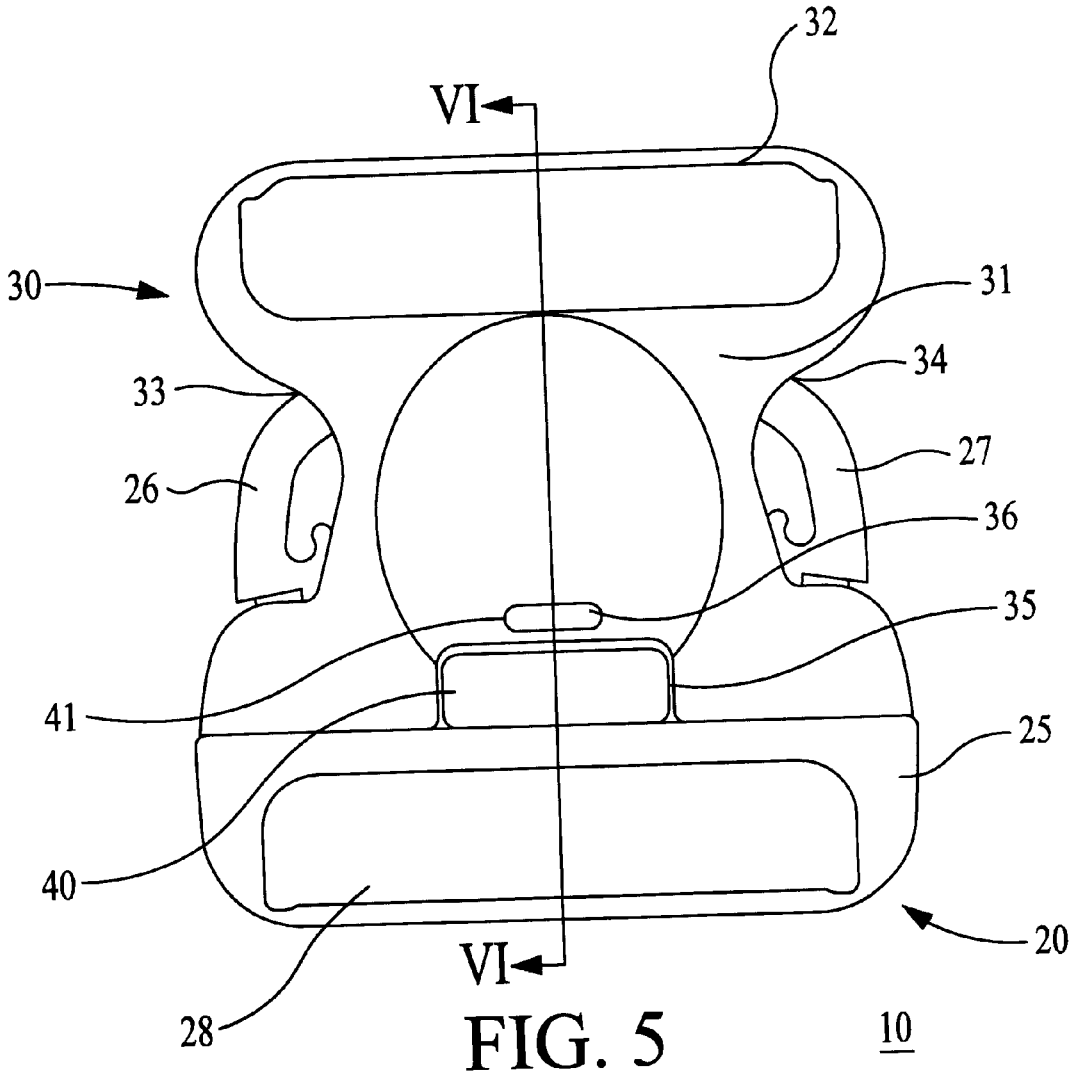
FIG. 5 shows a top view of the buckle assembly shown in FIG. 4.
Figure 6:
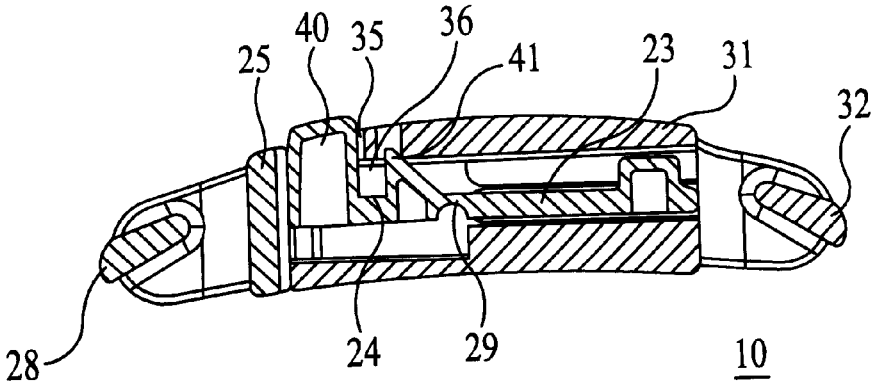
FIG. 6 shows a side cross-sectional view along lines VI—VI of FIG. 5.

In use, plug 20 is inserted into socket 30 until catch members 26 and 27 of side arms 21 and 22, respectively, snap into apertures 33 and 34, respectively, of socket 30. At: the same time, push button 40 slides into cutout 35 on socket 30 and catch 41 snaps into opening 36 on socket 30, as shown in FIGS. 4–6.

At this point, buckle assembly 10 is securely locked together. The only way to release plug 20 from socket 30 is to simultaneously press side arms 21 and 22 inward until catch members 26 and 27 clear apertures 33 and 34, and press push button 40 downward, forcing lever 24 to pivot and forcing catch 41 out of opening 36. Catch 41, once it clears opening 36, forces plug 20 to slide out of socket 30, due to the triangular sloped front side of catch 41.

Because catch 41 and push button 40 are located near the end of plug 20 closest to the strap bar, and far away from catch members 26 and 27 of side arms 21 and 22, it is impossible to press push button 40 and side arms 21 and 22 simultaneously with one hand to release buckle assembly 10. Thus, buckle assembly 10 is a highly secure buckle assembly that requires two hands in simultaneous action to release.

Additionally, the strength of buckle assembly 10 is enhanced because the pull on catch 41 is toward the pivot point on fulcrum 29. Thus, high degrees of tension on buckle assembly 10 will actually force catch 41 even deeper into opening 36, to even more securely lock buckle assembly 10 together. This feature ensures that buckle assembly 10 will not become inadvertently disengaged under high stresses.

Accordingly, while only a single embodiment of the present invention has been shown and described, it is obvious that many changes and modifications may be made thereunto without departing from the spirit and scope of the invention.

What is claimed is:

1. A buckle assembly comprising:

(a) a plug portion having a top surface and a bottom surface and comprising:
  (i) a base;
  (ii) a pair of parallel side arms attached to said base and extending away from said base, said side arms being flexible toward each other; and
  (iii) a center arm disposed between said side arms and connected to said base and having a free end, said center arm having a push button disposed adjacent said base and a catch disposed adjacent said push button, said catch and push button extending upward from said top surface; and (b) a socket portion having a top surface, a bottom surface, two sides and an open end for receiving said plug portion, each of said sides having an aperture for receiving an end of one of said side arms, and said top surface having a space to allow the catch to protrude therethrough when said plug portion is inserted in said socket portion;

wherein the buckle assembly is locked by inserting the plug portion into the open end of the socket portion until the side arms protrude through the apertures and the catch protrudes through the space, and wherein the buckle assembly is disengaged only by simultaneously pressing the push button downward and the side arms inward until the catch clears the space and the side arms clear the apertures in the socket portion.

2. The buckle assembly according to claim 1, wherein at least one of the plug and socket portions have a strap retaining bar mounted thereon.

3. The buckle assembly according to claim 1, wherein the push button is disposed adjacent the open end of the socket portion when the plug portion is inserted in the socket portion, and wherein the socket has an indentation along the open end for receiving the push button.

4. The buckle assembly according to claim 1, wherein the center arm has a lever on which the push button and catch are disposed, said lever having a free end terminating adjacent the base, wherein said push button is disposed at said free end of said lever.

5. The buckle assembly according to claim 4, wherein said lever has a fulcrum disposed approximately halfway between the base and the free end of the center arm.

6. The buckle assembly according to claim 5, wherein the lever is integrally formed with the center arm via a substantially U-shaped cutout in the center arm.

7. The buckle assembly according to claim 6, wherein the fulcrum of the lever comprises a portion of the center arm that is thinner than the rest of the center arm.

8. The buckle assembly according to claim 1, wherein the catch has a triangular cross-section such that one side extends perpendicular to the top surface of the plug portion and another side slopes upward from the top surface of the plug portion, wherein said one side faces said push button and said another side faces away from the push button.

9. The buckle assembly according to claim 1, further comprising a catching member disposed at a free end of each side arm, such that inserting the plug portion into the socket portion causes the catching members to protrude through the apertures and lock the plug portion into the socket portion.

* * * * *